United States Patent [19]

Heikkinen

[11] 4,180,109

[45] Dec. 25, 1979

[54] APPARATUS FOR TIMBER BARKING

[75] Inventor: Urho Heikkinen, Helsinki, Finland

[73] Assignee: Kone Osakeyhtio, Helsinki, Finland

[21] Appl. No.: 840,478

[22] Filed: Oct. 6, 1977

[30] Foreign Application Priority Data

Oct. 11, 1976 [FI] Finland ..... 762899

[51] Int. Cl.[2] ..... B27L 1/02

[52] U.S. Cl. ..... 144/208 D; 144/246 R; 144/246 B; 144/311; 198/458

[58] Field of Search ..... 198/458, 456, 786, 780; 144/208 R, 208 D, 311, 246 R, 246 B

[56] References Cited

U.S. PATENT DOCUMENTS

| | | | |
|---|---|---|---|
| 1,087,959 | 2/1914 | Lisherness et al. | 144/208 D |
| 1,300,748 | 4/1919 | Lombard | 144/208 D |
| 2,338,136 | 1/1944 | Shaw et al. | 144/208 D |
| 2,413,341 | 12/1946 | Swift | 144/208 D |
| 2,490,165 | 12/1949 | Shaw | 144/208 D |
| 2,809,683 | 10/1957 | Hoiss | 144/208 D |
| 3,029,923 | 4/1962 | Bilocq et al. | 198/456 |

*Primary Examiner*—Robert L. Spruill
*Assistant Examiner*—W. D. Bray
*Attorney, Agent, or Firm*—Haseltine, Lake & Waters

[57] ABSTRACT

Apparatus for barking timber, comprising a barking drum and a pretreatment device for patching, that is barking of the timber in spots, the timber is subjected to slashing of its bark in a transverse, longitudinal or oblique direction, this pretreatment device is formed of conveyors and patching members. The conveyors consist of a set of spreading rolls, which spreads the timber longitudinally fed into the pretreatment device to the form of a uniform timber mat, which moves uniformly forward, and of a set of rotating rolls, which transports the pieces of timber and at the same time rotates them about their axes. The patching members previously known in themselves are associated with the set of rotating rolls.

5 Claims, 4 Drawing Figures

APPARATUS FOR TIMBER BARKING

BACKGROUND OF THE INVENTION

Certain timber barking drums have a pretreatement apparatus which patches the timber going into the barking drum. This pretreatment apparatus has the drawback in that it has to be constructed for only one bole at a time, whereby the capacity is limited by the transporting speed and is therefore too low.

SUMMARY OF THE INVENTION

The object of the invention is to eliminate the drawback mentioned and to provide a timber barking apparatus wherein pretreatment means has a high enough capacity in relation to the barking drum.

The apparatus of the invention is characterized in that the conveyors of the pretreatment means consist of a set of spreading rolls, which spreads the longitudinally fed timber into the pretreatment device and, in the form of a uniform timber mat, which moves uniformly forward. A set of rotating rolls, transports the pieces of timber and at the same time rotates them about their axes. Patching members previously known in themselves are located in working relation with the set of rotating rolls. When the timber is introduced into the pretreatment device with the aid of a belt conveyor in the longitudinal direction, the set of spreading rolls will spread this timber to form a uniform timber mat. At the same time, the timber mat is uniformly fed forward onto the set of rotating rolls, where the timber is furthermore fed in a forward direction while at the same time it is rotated by the set of rotating rolls in such manner that the patching members which co-operate with the set of rotating rolls may exert their effect on every side of the timber.

An advantageous embodiment of the invention is characterized in that the set of spreading rolls consists of rolls transverse to the longitudinal direction of the pretreatment device and placed one after the other, and which rolls carry helices ascending spirally toward the walls. Hence, it follows that the rolls spread the timber out with the aid of the helices towards the walls to constitute a mat, while at the same time the timber moves uniformly forward, being transported by the rolls. No jam-ups can develop because the timber moves away from the feeding aperture at once, to the side and further moves onward.

Another embodiment of the invention is characterized in that the set of rotating rolls consists of rolls placed side by side obliquely with reference to the longitudinal direction of the pretreatment means and which have annular grooves, which in combination constitute longitudinal passage and rotation channels. It follows as the timber moves uniformly forward transported longitudinally by the rolls, while at the same time the rolls rotate the pieces of timber adjacent to the patching members to obtain uniform results in the patching operation.

A third embodiment of the invention is characterized in that the patching members are high pressure water jets, previosuly known in themselves, directed upwardly through the interstices in a set of rotating rolls. It follows that one obtains in each passage and rotation channel, a correctly oriented patching member, such as a water jet, that a correct distance.

One embodiment of the invention is furthermore characterized in that above the set of rotating rolls there is a depressing means, such as a mat for instance, which keeps the pieces of timber in the passage and rotation channels. In order that the patching members directed upwardly through the interstices of the set of rotating rolls might not be able to lift or displace the timber residing in the channels, a depressing device has been provided above the set of rotating rolls that keeps the timber in the channels. The depressing device may also be formed of a plurality of longitudinal depressing arms.

The invention is described as follows with the aid of an example, with reference to the attached drawings wherein:

IN THE DRAWINGS

FIG. 1 presents the timber barking apparatus in an elevational view.

DESCRIPTION OF THE INVENTION

Figure 1:
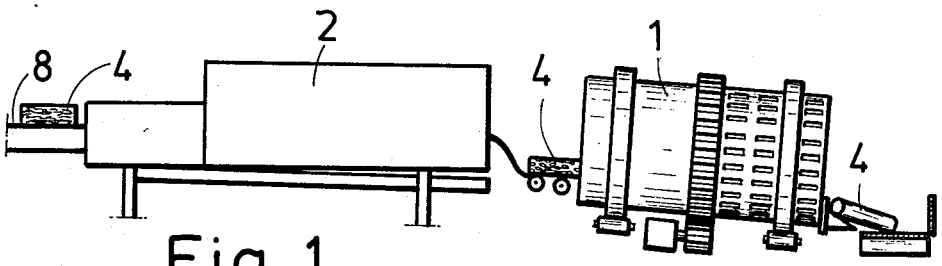
Figure 2:
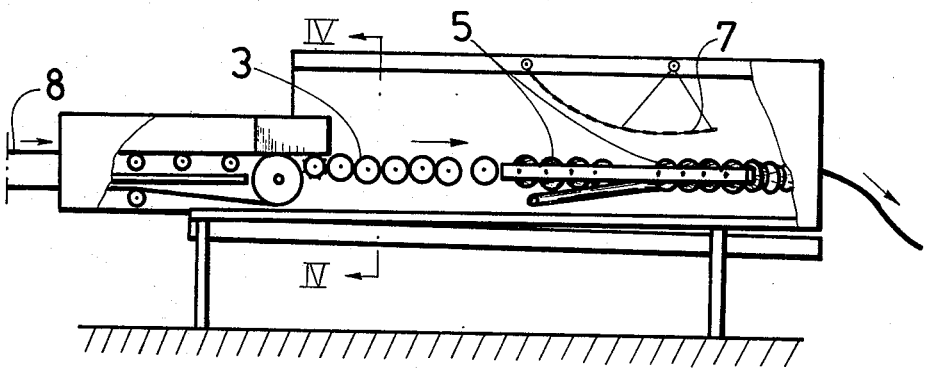
FIG. 2 shows the pretreatment means of the barking apparatus in elevational view and is partly sectioned.
Figure 3:
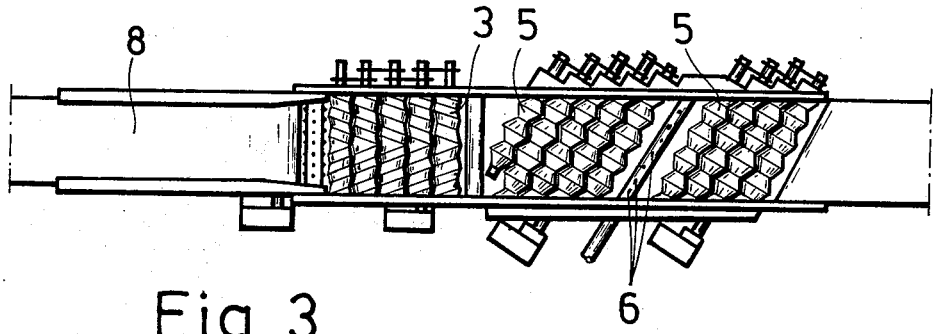
FIG. 3 shows the same means as FIG. 2, but viewed from above.
Figure 4:
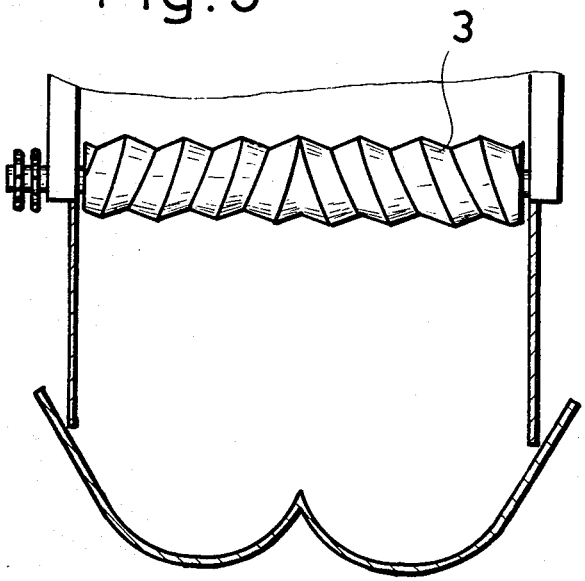
FIG. 4 shows the section along the line IV—IV in FIG. 2.

The timber barking apparatus of the invention employs a barking drum 1 and a pretreatment device 2 mounted before the drum. The pretreatment device 2 comprises a set of spreading rolls 3, which spreads the timber 4 out as it is fed in longitudinal direction into the pretreatment device, to form a uniform timber mat, and feeds it forward direction. A set of rotating rolls 5, transports the timber 4 along longitudinal paths and at the same time rotates it. Below the set of rotating rolls 5 there are nozzles 6 directed upwardly through the interstices of the rolls and by which high pressure water jets are directed against the timber, whereby these jets serve as patching members. The set of spreading rolls 3 consists of rolls placed consecutively and transversally in the longitudinal direction of the pretreatment means 2 and carrying helices which ascend spirally toward the walls. The set of rotating rolls 5 consists of rolls placed side by side, at an angle against the longitudinal direction and which have annular grooves, these grooves in combination forming longitudinal passage and rotation channels for the timber 4. A mat 7 is disposed above the set of rotating rolls 5, which presses down on the timber 4 and keeps it in the passage and rotation channels.

The timber which is meant to be barked, 4, is fed by means of a belt conveyor 8 in longitudinal direction into the pretreatment means 2, where there is first the set of spreading rolls 3, upon which the timber 4 spreads out to form a uniform timber mat, so that no jams may develop. The set of spreading rolls 3 transports the timber mat uniformly forward to the set of rotating rolls 5, which presents longitudinal channels formed by the annular grooves in combination, and into which the timber 4 settles. The set of rotating rolls 5 further transports the timber 4 forwardly at a uniformly speed, while rotating it at the same time. Water jets 6 are below the set of rotating rolls 4 and directed upwardly through the interstices of the rotating rolls to cause uniform patching of the timber 4 residing upon the set of rotating rolls 5. From the set of rotating rolls 5, with timber proceeds into the barking drum 1, where the timber is completely barked.

It is obvious to one skilled in the art that different embodiments of the invention may vary within the scope of the claims following below. For instance, the timber may be rotated upon the set of rotating rolls with the aid of a separate rotating means, such as a chain or a roll carrying a helix. The patching members 6 may equally be, for instance, some kind of mechanically operating blades known in prior art. In the foregoing there has been talk of patching, or spotwise barking of the timber. But it is obvious that it is possible by the same apparatus to make in the bark also transversal, longitudinal or oblique slashes, which are required in the barking process of certain timber species.

I claim:

1. In an apparatus for timber barking having a barking drum, timber bark pretreatment means adapted to receive and spot bark a plurality of timber pieces in their line of travel to said barking drum, conveying means for conveying said timber through said pretreatment means, said pretreatment means including patching means therein, the improvement which comprises:

said conveying means including a plurality of conveyors sequentially disposed along the longitudinal line of travel, one of said conveyors comprising a set of spreading and forwarding rolls having helices thereon, said spreading and forwarding rolls being adapted to spread longitudinally fed timber into the pretreatment means to form a uniform timber mat and to longitudinally advance said mat, a second conveyor comprised of a set of rotating rolls disposed at an angle to the longitudinal direction of timber travel for transporting the timber to said barking drum while at the same time rotating the same about their longitudinal axes.

2. An apparatus according to claim 1, wherein the set of rotating rolls comprises rolls placed side by side, obliquely with reference to the longitudinal direction of the pretreatment means and having annular grooves, which in combination constitute longitudinal passage and rotation channels.

3. An apparatus according to claim 1, wherein: the set or rotating rolls is in proximity with depressing means, said depressing means are in the form of a mat acting on the timber to contain said timber in rotation channels during passage therethrough.

4. An apparatus according to claim 1 wherein said set of spreading rolls comprise rolls placed consecutively and transversally with respect to the longitudinal path of travel of said timber, said helices being disposed on said spreading rolls in a manner spirally ascending from the centers to the ends thereof.

5. An apparatus according to claim 1, wherein said patching means comprises high pressure water jets directed upwardly through the interstices of said set of rotating rolls for spot barking said timber.

* * * * *